United States Patent [19]

Werner

[11] Patent Number: 4,948,281

[45] Date of Patent: Aug. 14, 1990

[54] KEYBOARD PROTECTED AGAINST VANDALISM AND SPILL

[75] Inventor: Arend Werner, Boeblingen, Fed. Rep. of Germany

[73] Assignee: International Business Machines Corporation, Armonk, N.Y.

[21] Appl. No.: 416,815

[22] Filed: Oct. 4, 1989

[30] Foreign Application Priority Data

Dec. 17, 1988 [EP] European Pat. Off. ..... 88121198.1

[51] Int. Cl.[5] ..... B41J 5/10

[52] U.S. Cl. ..... 400/472; 400/676

[58] Field of Search ..... 400/676, 677, 678, 691, 400/693, 473, 472, 690, 692, 690.1, 690.2, 690.4, 694, 689, 713, 714, 496; 235/145 R, 146

[56] References Cited

U.S. PATENT DOCUMENTS

| | | | |
|---|---|---|---|
| 4,359,612 | 11/1982 | Rooney | 400/472 X |
| 4,449,763 | 5/1984 | Barnett | 400/691 X |
| 4,671,688 | 6/1987 | Brashears | 400/472 X |

*Primary Examiner*—Edgar S. Burr
*Assistant Examiner*—Motilal P. Patel
*Attorney, Agent, or Firm*—Laurence R. Letson

[57] ABSTRACT

The invention provides means to protect a widely used keyboard such as the IBM XT PC and PS/2 keyboard against vandalism and spill if such a keyboard is used in exposed situations, e.g. in self-service application/transaction machines which are publically accessible and unattended. On the base plate or housing 1 respectively of the keyboard 12 a grid plate 8 is fixed. This grid plate has openings 10 arranged in the pattern of the keys and in such a size that the cone-like keys 11 cannot be removed toward the top. The grid plate may be fixed directly to the keyboard housing or by means of a supporting frame 4 which is secured to the housing. In both cases grid plate or supporting frame respectively include a rim 5 to form a shallow trough 21 with the keyboard housing. A gasket 2 is provided between grid plate or supporting frame respectively and the keyboard housing. A drain 3 is provided in the rim to give controlled outflow. Thus spilled liquid cannot intrude over the edges into the interior of the keyboard housing and by the grid plate the removal of keys toward the top is not possible.

7 Claims, 3 Drawing Sheets

KEYBOARD PROTECTED AGAINST VANDALISM AND SPILL

DESCRIPTION

The invention relates to a keyboard having a housing comprising in rows and columns apertures for keys, said housing having stem-like chimneys protruding from a base plate and forming said apertures, said chimneys being open to the top of the keyboard and being adapted for carrying keys, each of said keys having an umbrella or cone-like cap with a base wider than the top and wider than the opening of said chimney.

The PCT Application WO 81/00762 (PCT/US 80/00940) describes a photo-optical keyboard having an improved keyboard housing and keys for the purpose of confining debris and liquid spills on the keyboard. The keyboard housing has a matrix of rows and columns of apertures for keys. The housing has recesses open to the top of the keyboard between the apertures. Further, there are structural supports between the apertures which separate the recesses and cause the recesses to be reservoirs. Multiple keys are positioned in the keyboard housing apertures. Each of the cone-like keys has an umbrella cap with lower edges extending over the recesses. Liquid or debris spilled on the umbrella cap will fall into recesses to be contained. This known keyboard construction does not give the possibility to the contained liquid to leave the area between the stem-like key openings. That means that liquid and debris spilling are confined in the recesses and can only be removed by cumbersome means. The very serious problem of avoiding the possibility to remove the keys or the key caps to the top from the keyboard is not at all addressed by this citation.

Another example of a keyboard having a housing from which stem-like chimneys protrude in which keys are confined and guided, is described in the German Gebrauschsmuster G 87 00 721.5. The cone-like formed hat or cap of the key has lower edges that are wider than the top edges, and the lower edges are also wider than the opening of the keyboard housing or chimneys respectively. The cap overlaps the chimney thus avoiding that spill can intrude into the openings of the keyboard housing. Liquid spilled over such a keyboard housing might not intrude into the chimneys directly. Anyhow it is possible that liquid intrudes into the housing at the edges of the keyboard housing when running across the plate of the keyboard housing. So also this construction does not avoid completely the intruding of spill liquid into the housing. Furthermore it does not at all address the avoidance of the possibility to remove cone-like caps toward the top of the keyboard.

Also in the German Patent DE 33 25 409 C2 there is described a keyboard with discrete keys having a cone-like cap or hat form respectively. The keys are guided in chimneys protruding from the keyboard housing. Those chimneys forming on the inside apertures in which the stems of the keys are guided to switch underlying switch means if they are pressed down. Again, the caps or key buttons have lower edges that are wider than the openings of the chimneys and overlap those. Between the chimneys there is given space to confine debris and spilled liquid. Also here the problem exists that spilled liquid running over the edges of the keyboard housing might intrude there into the interior of the keyboard. Furthermore, the problem of avoidance of the removal of the caps toward the top is not addressed at all. constructed from the beginning to be protected against vandalism and spill problems. It is not considered to make out of a widely used keyboard of special design a keyboard which by simple means can be made spill prove and vandal-protected.

A further means to protect keyboards against vandalism is shown in U.S. Pat. No. 4,449,763. There a protective cover in the form of a transparent hood is fixed to the housing of the machine and allows only that the operator can insert his hand between the keyboard and the hood. The distance between the top of the hood and the buttons of the keyboard is sufficient to allow normal hand and finger movement by the operator, but to close to permit any appreciable hole-hand movements normally to the keyboard whereby the operator cannot strike the keyboard buttons with accessive force which can damage the machine. Also the hood prevents access of spilled liquid and other debris to the keyboard. A keyboard provided with such a hood can only be used in a certain design arrangement because it must be certain that the operator can insert his or hers hand between the hood and the keyboard panel. Thus the possibilities to include such a keyboard into a machine are very limited. There is no possibility to have open access from the top to the keyboard which makes it unaccessable for most applications.

It is the object of the present invention to provide out of a widely used standard keyboard such a keyboard that is protected against vandalism and spill. This should be reached by simple means and without changing anything at the base keyboard itself.

These objects as well as others are basically solved using a keyboard as provided in the preamble of claim 1 A keyboard in which the removal of keys towards the top of the keyboard might be avoided is shown in the European Patent 0 088 365 B1. There a keyboard is described in which the keys are arranged in a carrier plate and in which a contact plate with electrical switching contacts is arranged underneath the keys. The contact plate presses the keys toward the supporting plate. The keys themselves have a special form with a wider foot part resting underneath the carrier plate. The body of the key itself is somewhat cone-like formed and protrudes through the opening within the carrier plate to the top of the keyboard. By the construction of the wider foot of each key this key cannot be removed toward the top of the keyboard. When the key in this kind of keyboard construction is depressed, there is generated a gap between the key and the carrier plate. Thus upon depressing of such a key spilled liquid standing on the support plate and the top of the keys, might intrude into the interior of the keyboard. So this construction cannot be considered to be spill prove.

In the UK Patent Application GB 2 046 524 A there is described a keyboard comprising a rigid apertured top plate and a tray-like aperture retention plate placed against the back of the top plate to define a cavity therebetween. The operating button operates within the cavity and extends trough the apertures in the two plates. The inward and outward movement is limited by a flange arranged around the button. A sheet of resilient material is sandwiched between the retention plate and the rigid backing plate to thereby seal the cavity. The construction is deemed to provide a very tough switch usable in arduous environments and where vandalism is a problem. This known construction provides a special purpose keyboard, specially and by applying the features laid down in the characterizing clause of claim 1.

In advantageous manner the invention provides that the removal of keys toward the top of the keyboard is not possible and that spilled liquid is hindered to intrude over the edges into the interior of the keyboard housing.

Further developments and advantageous attainments of the present invention are laid down in the dependent claims.

The above and other objects, features and attainments of the present invention will become more apparent for those skilled in the art upon reading the following detailed description taken in conjunction with the accompanying drawing which show an illustrative embodiment of the invention and in which FIG. 1 consisting of FIG. 1A to D shows different parts that form in conjunction the invention;

Figures 1A, 1B, 1C, 1D:
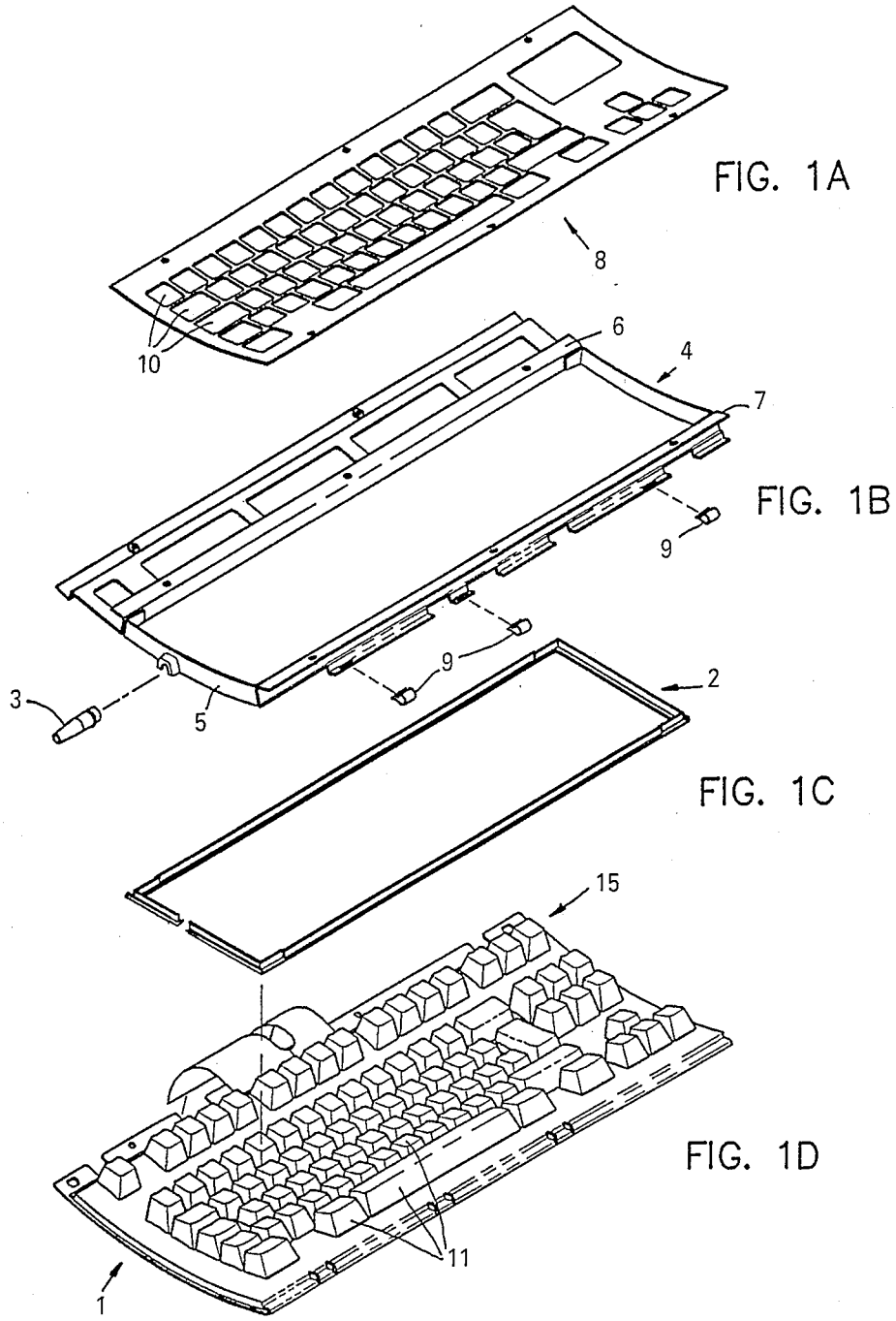

FIG. 1 consisting of FIG. 1A, 1B, 1C and 1D shows different parts which together form the protected keyboard in accordance with the present invention. So as basis in FIG. 1D in perspective view a standard PC keyboard base group 1 is shown. FIG. 1C shows above FIG. 1D a rubber gasket 2 and a drain 3 separate from it together with FIG. 1B. The gasket and the liquid drain could be separate parts as shown or they could be one single part. In any case the gasket fits on the base group 1 to seal a certain part of the keyboard. Above the FIG. 1C with the gasket 2 and the liquid drain 3 there is shown in FIG. 1B a grid support 4 that also could be called supporting frame. The supporting frame 4 has a rim 5 of rectangular form. On both sides along the length side of this rim 5 there are provided two flanges 6 and 7. Also shown in FIG. 1B are clamps 9 by which the supporting frame 4 might be connected to at one length side to the base group 1. Above FIG. 1B there is shown in FIG. 1A a grid plate 8. This grid plate 8 has openings 10 that are arranged in the same pattern as the keys 11 on the base group 1 shown on FIG. 1D as will be apparent later on. The size of the openings 10 is chosen such that the asymmetric conically formed key buttons cannot be removed toward the top of the keyboard if grid plate 8 is fixed to the supporting frame 4.

Figure 2:
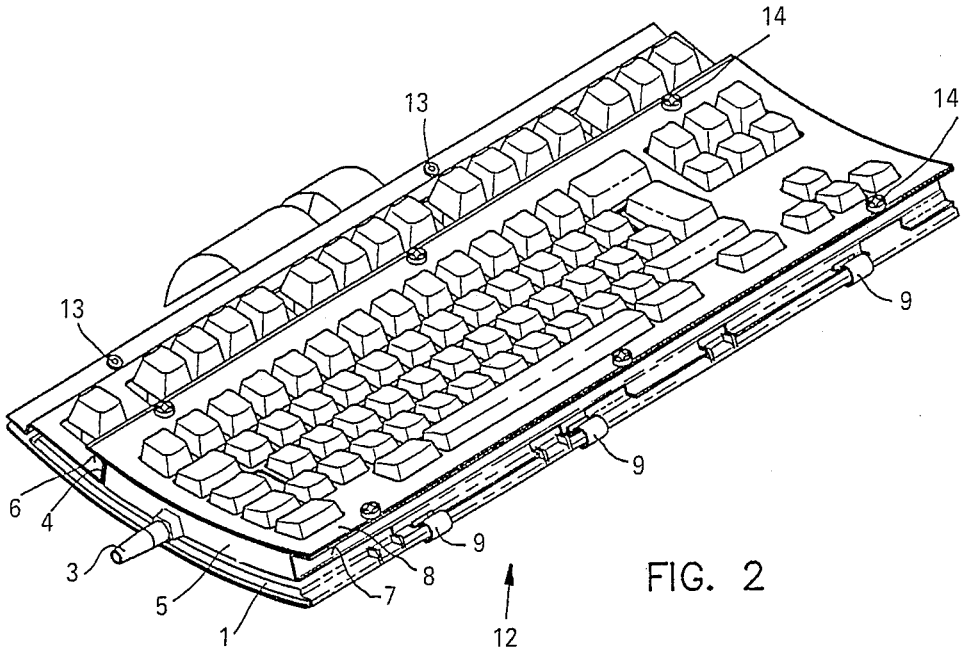
FIG. 2 shows a perspective view of the protected keyboard in accordance with the present invention.

In FIG. 2 there is shown the completely assembled protected keyboard 12 consisting of the base group 1 to which the supporting frame 4 is fixed. Fixing is performed on one side by the clamps 9 and on the other side by screws 13. To the supporting frame 4 with its side flanges 6 and 7 there is secured the grid plate 8 by means of screws 14. As can be seen from FIG. 2, the rim 5 of the supporting frame 4 provides a distanced fixture of the grid plate 8, distanced from the base part 1. By this arrangement above the surface of the base group 1 the rim 5 forms a shallow trough. Liquid contained in this trough may be outflow controlled in manner through the liquid drain 3.

Figure 3:
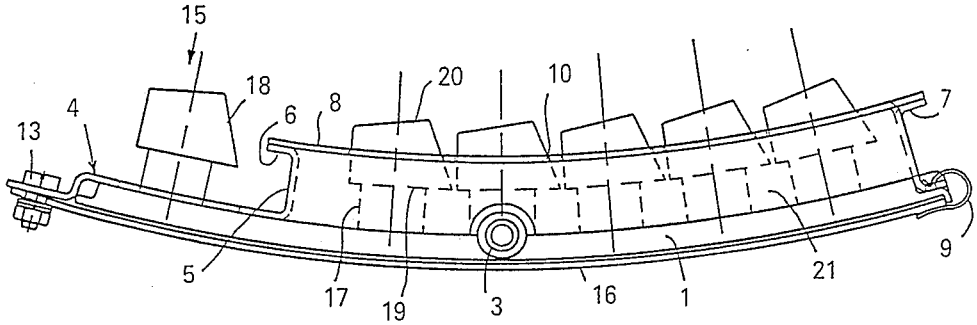
FIG. 3 shows a side view of the protected keyboard of FIG. 2.

In FIG. 3 there is shown a side view of the assembled and protected keyboard 12 as shown in FIG. 2. In this example the upper row 15 (see FIG. 1D) of key buttons is not confined by the grid plate 8. Only the five rows on the right hand side of row 15 are confined by grid plate 8. This grid plate 8 is fixed to the flanges 6 and 7 of supporting frame 4. As can be seen, supporting frame 4 is fixed to the base group 1 by means of base plate 16 and the clamps 9 on the right hand side and the screw connection 13 on the left hand side.

As further can be seen, emanating from the base group 1 there are stem-like chimneys 17 on top of which the key buttons 18 are provided. Those key buttons 18 are formed asymmetric conically. The lower edges 19 are all longer than the top edges 20 of each single key button 18. To avoid that a key button 18 can be removed from the stem-like chimney 17 to the top of the keyboard the openings 10 in the grid plate 8 have a size between the measuring values given by the lower edges 19 and the upper edges 20 of each associated key button. Thus a removal toward the top is avoided.

As also can be seen from FIG. 3 through the liquid drain 3 all liquid confined in the shallow trough indicated by the reference number 21 and collected above base group 1 and between the rim 5 can be disposed in controlled manner through the liquid drain 3.

Figure 4:
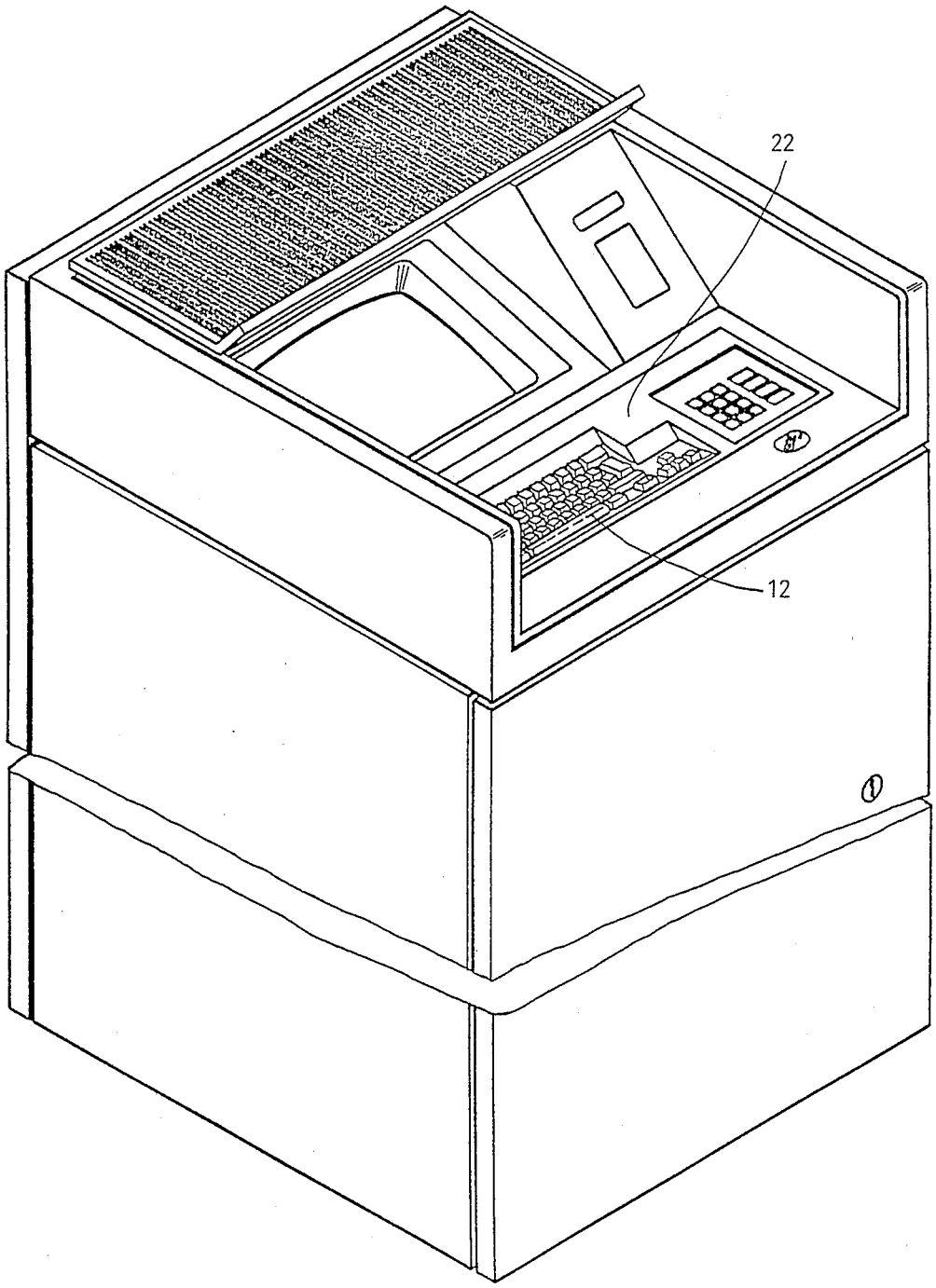
FIG. 4 shows a keyboard protected in accordance with the present invention built-in in a self-service transaction terminal such as the IBM 4737.

FIG. 4 shows the keyboard protected against vandalism and spill in accordance with the present invention incorporated into a self service transaction station like the IBM 4737. For a person using this keyboard for entering information and commands into the machine there are exposed to that person only those keys which are necessary. That means for example then that the keys in row 15 (see FIG. 1D) and the six keys below row 15 on the right hand side in FIG. 1D, are covered by a special cover 22. Therefore in the example shown in the different FIGS. 1, 2, 3, the row 15 is not included into the supporting frame and the aperture grid plate.

In the example shown in the FIGS. there is provided a separate supporting frame 4. It is clear to a person skilled in the art, that to the grid plate 8 there could be provided immediately in one and the same piece the rim 5. Furthermore the supporting part could be provided in one piece together with the grid plate 8 and immediately secured and fixed to the base group 1 of the keyboard. Also other fixing means as clamps 9 or screws 13 and 14 could be provided. It also can be provided that the edges of the openings 10 have a slope coinciding with slopes of the immediately adjacent sides of the appropriate key button.

I claim:

1. Keyboard having a housing comprising apertures for keys, said apertures being arranged in a pattern of rows and columns and said housing (1) having including a base plate stem-like chimneys (17) protruding and forming said apertures, said chimneys being open to the top of the keyboard and being adapted for carrying keys (18), each of said keys having an umbrella or cone-like cap with a base edge (19) and a top edge (20), the base edge being wider than both the top edge and the opening of said chimney, (a) a grid plate (8) having openings (10) arranged in the same pattern as said keys are arranged on said keyboard housing, (b) each of said openings in said grid plate having a size less than the size of the base edges (19) and greater than the size of the top edges (20) of each associated key cap, (c) said size of said openings in said grid plate being chosen such that when said grid plate is placed over the key caps each key is secured against removal from its associated chimney, (d) said grid plate being fixed to said housing.

2. Keyboard as in claim 1, wherein (a) said grid plate includes a rim at its edges, (b) said rim and said base plate being connected such that they form a flat trough (21) for collecting spills or liquid respectively.

3. Keyboard as in claim 1, wherein a supporting frame (4) is provided on said housing, said supporting frame forming a rim (5) in cooperation with said housing.

4. Keyboard as in claim 1 wherein a gasket ring (2) is provided between the edge of said housing and the edge of said grid plate.

5. Keyboard as in claim 2 wherein a drain (3) is provided in said rim to provide controlled overflow of a collected liquid spill.

6. Keyboard as in claim 1 wherein said grid plate being detachably fixed (14; 9, 13) to said housing.

7. Keyboard as in claim 1 wherein the edges of said key openings provided in said grid plate have a slope coinciding to the associated sides of said key caps.

* * * * *

UNITED STATES PATENT AND TRADEMARK OFFICE

CERTIFICATE OF CORRECTION

PATENT NO. : 4,948,281

DATED : August 14, 1990

INVENTOR(S) : Arend Werner

It is certified that error appears in the above-identified patent and that said Letters Patent is hereby corrected as shown below:

Column 1, line 68 After "all." remainder of text in Column 1 and Column 2, lines 1-34 should be moved to Column 3, line 1 After "specially".

Column 2, line 35 Indent for new paragraph.

Column 4, line 48 Delete "having"; line 49 After "plate" insert --having--.

Signed and Sealed this

Thirty-first Day of December, 1991

*Attest:*

HARRY F. MANBECK, JR.

*Attesting Officer*

*Commissioner of Patents and Trademarks*